US005179979A

United States Patent [19]

Zollinger

[11] Patent Number: 5,179,979

[45] Date of Patent: Jan. 19, 1993

[54] RAPIER LOOM WITH INCLINED TAPE GUIDE

[75] Inventor: Hans Zollinger, Tann-Ruti, Switzerland

[73] Assignee: Sulzer Brothers Limited, Winter, Switzerland

[21] Appl. No.: 705,318

[22] Filed: May 24, 1991

[30] Foreign Application Priority Data

Jul. 16, 1990 [CH] Switzerland ..... 02364/90

[51] Int. Cl.[5] ..... D03D 47/18

[52] U.S. Cl. ..... 139/449

[58] Field of Search ..... 139/449, 133, 142, 155, 139/440–448, 437, 438

[56] References Cited

U.S. PATENT DOCUMENTS 3,777,787 12/1973 Anderson ..... 139/449
4,003,412 1/1977 Volpe ..... 139/449
4,973,932 12/1990 Pezzoli ..... 139/449

FOREIGN PATENT DOCUMENTS 1001345 10/1989 Belgium .
2931212 2/1981 Fed. Rep. of Germany .
2187970 1/1974 France .

*Primary Examiner*—Andrew M. Falik
*Attorney, Agent, or Firm*—Kenyon & Kenyon

[57] ABSTRACT

The gripper loom has picking tapes and rapier heads whose centers of gravity are disposed above the top of the tape. Between the tape wheels and the shed, tape guides are provided to impart to the picking tapes an inclined direction of movement towards the shed. Due to these inclined tape guides, disengagement of the rapier heads from the raceway in the shed can be obviated, with a consequent reduction in the frequency of warp yarn breakages.

9 Claims, 1 Drawing Sheet

RAPIER LOOM WITH INCLINED TAPE GUIDE

Figure 1:
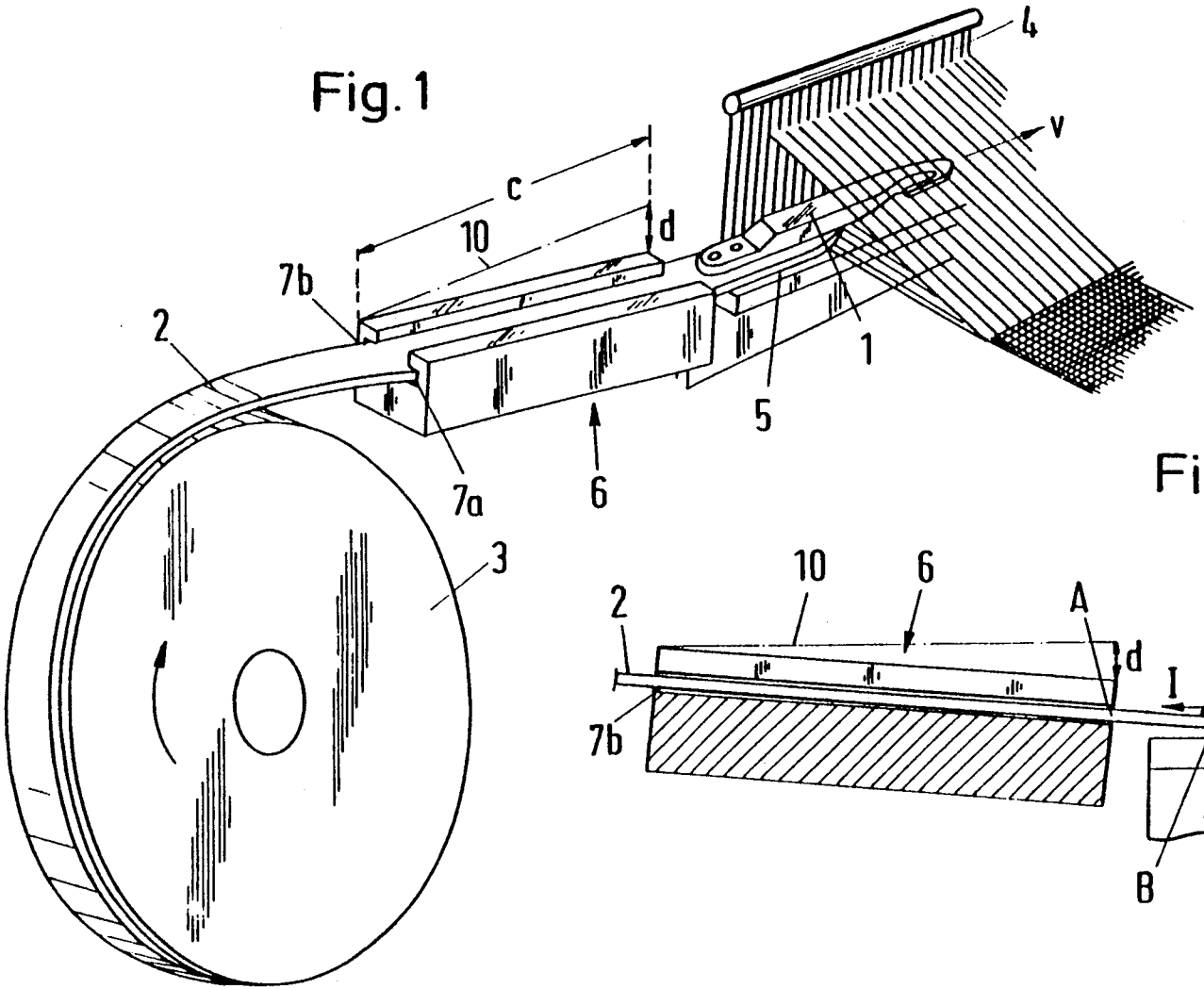

This invention relates to a rapier loom. More particularly, this invention relates to an arrangement in a rapier loom for guiding a picking tape.

As is known, rapier looms have been constructed so as to direct a giver rapier with a weft yarn thereon into a shed of warp yarns for transfer to a taker rapier a. a central zone of the shed with the taker rapier completing the picking operation of the weft yarn. In this respect, the giver rapier and the taker rapier have each been formed of a picking tape to which a rapier head is secured at one end for gripping of a weft yarn. In addition, The rapiers have been guided in the shed via the warp yarns and a raceboard. Further, in order to prevent damage to the bottom warp yarns, the raceway or the like has been embodied by plate-like support teeth which are aligned parallel to the warp yarns.

The following comments relate to rapier looms having giver and taker rapiers but are also applicable to looms in which picking is effected just by means of a giver rapier on one side, the weft yarn being transferred outside the shed by means of a stationary device.

During operation, the rapier heads experience a maximum acceleration in the shed entry zone. The resulting forces of inertia thus produce torques whose possible effect on the flexible tapes may be that the rapier heads disengage from the raceboard.

As is known, individual warp yarns in the top shed may, because of a loss of tension, unavoidably not remain stretched coplanar with the other warp yarns in the top shed. If this occurs, the sagging warp yarns may be severed by the rapiers, particularly should the rapier heads disengage from the raceboard. Thus, in order to reduce the frequency of warp yarn breakages, endeavours must be made to obviate disengagement of the rapier heads.

It is know, for example, from U.S. Pat. No. 4,126,159 to use magnets to apply stabilizing forces to rapier movement. Means of this kind can obviate disengagement, but the use of magnets leads to fresh problems such as the excitation of vibrations, demagnetization of permanent magnets, additional power consumption in the case of electromagnets and heavier rapier heads due to the use of ferromagnetic material.

Accordingly, it is an object of the invention to reduce the possibility of disengagement of a rapier head from a raceboard in a rapier loom.

It is another object of the invention to provide a relatively simple construction to reduce disengagement of a rapier head from a raceboard in a rapier loom.

Briefly, the invention provides a rapier loom which has a raceway for supporting a picking tape in a shed of warp yarns and a tape wheel having a picking tape wound thereon with a means between the tape wheel and shed for guiding the tape at an inclination towards the shed. This means may be in the form of a tape guide which is disposed at an angle to the raceboard for directing the picking tape onto the raceboard at an angle. In this respect, the tape guide is disposed between the tape wheel and the shed of warp yarns with the guide being disposed on a gradient of from 0.2 to 0.8%.

The picking tape is also provided with a rapier head which is secured to the tape with a center of gravity disposed above the top of the tape.

The guidance of the picking tape is such that the picking tape and rapier head thereon can enter the shed at a slightly descending gradient. As compared with conventional rapier looms, the raceboard must be disposed at a lower level relative to the embarcation point of the tape from the tape wheel.

Figure 2:
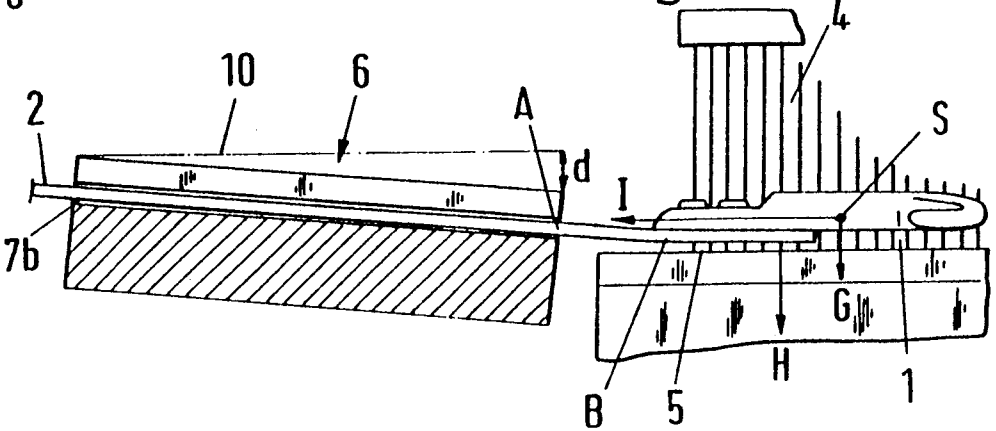

These and other objects and advantages of the invention will become more apparent from the following detailed description taken in conjunction with the accompanying drawings wherein:

FIG. 1 illustrates a perspective view of the taker side of a rapier loom near a shed according to the invention; and FIG. 2 illustrates a view in longitudinal section of the taker guide and the taker rapier head near the edge of a sley.

Referring to FIGS. 1 and 2, the rapier loom includes, inter alia, a taker rapier having a head 1 secured to a picking tape 2 which, in turn, is wound on a tape wheel 3. In addition, the loom includes a reed 4 of conventional structure disposed within a shed of warp yarns for the formation of a cloth, a raceboard 5 of a sley and means in the form of a tape guide 6 for guiding the tape 2 towards the shed.

As indicated, the head 1 of the taker rapier is introduced into the shed at a speed v under an oscillating movement of the wheel 3.

The tape guide 6 is formed with two grooves *7a*, *7b* for guiding the edges of the picking tape 2. In addition, in order to avoid disengagement of the head 1 from the raceboard 5, the tape guide 6 is inclined relative to a horizontal 10, there being a height difference d over the length c of the guide 6. As tests have shown, a gradient, i.e. a quotient of d : c—of from 0.2 to 0.8%, depending upon loom speed and rapier head weight, suffices to reduce disengagement of the rapier considerably.

Referring to FIG. 2, wherein like characters indicate like parts as above, the head 1 is secured to the tape 2 with the center of gravity S of the head and disposed above the top of the tape 2. During entry of the head 1 into the shed, the forces acting on the head 1 are indicated by arrows G, H and I. Since the alteration in rapier speed is at a maximum in the shed entry zone, the inertia force I which is of course proportional to the acceleration is at its maximum in such zone. Thus, the inertia force I exerts a bending moment on the flexible tape 2 which is responsible for the tendency to disengage. The weight G of the rapier head I opposes the inertia force I, as does also a force H produced by the flexing of the tape 2 between the tape guide exit aperture, i.e. a position A, and the back end of the head 1, i.e. a position B. The flexing of the tape 2 between positions A and B depends upon the inclination given the tape guide 6. The bending force H is greater in proportion as the gradient of the inclination is greater. Consequently, if the gradient of the tape guide 6 is chosen appropriately, the inertia force I can be compensated for by the bending force H which acts in addition to the weight G.

In the withdrawn position, the head 1 is disposed completely within the tape guide 6. The raceboard 5 must therefore be no higher than the bottom edge of the tape guide exit aperture at the position A, otherwise of course problems occur at the transfer of the head 1 from the tape guide 6 to the raceboard 5. FIG. 2 shows the same arranged lower down.

The flexing of the tape 2 between positions A and B and the flexing or bending force H is greater in proportion as the raceboard 5 is higher. To produce a very considerable flexing force H, therefore, the raceboard 5 must be disposed at the same height as the bottom edge at position A. However, a substantial flexing force H may damage the warp yarns of the bottom shed since the latter force, unless compensated for by the oppositely acting inertia force, is applied by way of the bottom warp yarns to the raceboard 5. It is therefrom advantageous, in some circumstances, for the raceboard 5 to be placed not in the highest possible position but, as shown in FIG. 2, at a lower position, e.g. at least 1 millimeter lower than the exit aperture of the tape guide 6.

The bending force H also also decreases as the distance between the positions A and B increases. The force H can therefore be controlled by shifting the tape guide exit aperture for adaptation as regards the inertia force I.

In the event of an article change, loom speed may have to be altered and the rapier heads replaced by different heads. As a rule, it is advisable in such cases to adapt the gradient of the guide 6, the distance from the guide 6 the sley and the raceboard height. Advantageously, therefore, the rapier loom is so constructed that the inclination of the guides 6, the distance between the guide 6 and the sley and/or the height of the raceboard 5 are adjustable.

The invention thus provides an arrangement for passage of a picking tape into a shed which substantially reduces, if not eliminates, disengagement of a rapier head from a raceboard.

What is claimed is:

1. A rapier loom comprising a raceboard for supporting a picking tape in a shed of warp yarns;

a picking tape for movement into the shed;

a rapier head secured to said tape and having a center of gravity disposed above a top of said tape; and means for guiding said tape at a downward inclination towards the shed, said means being located outside the shed.

2. A loom as set forth in claim 1 which further comprises a tape wheel having said picking tape wound thereon and wherein said means includes a tape guide between said tape wheel and the shed, said guide being disposed on a gradient of at least 0.2%.

3. A loom as set forth in claim 1 wherein said means for guiding said tape at an inclination towards the shed includes a tape guide having an exit aperture at one end for said tape and wherein said raceboard is disposed at a height at least 1 millimeter lower than said aperture.

4. A loom as set forth in claim 1 wherein said means for guiding said tape at an inclination towards the shed includes a tape guide having an exit aperture at one end for said tape and wherein said raceboard is disposed at a height of said aperture.

5. A rapier loom comprising a raceboard for supporting a picking tape in a shed of warp yarns; and a tape guide disposed at a downward angle to said raceboard for directing a picking tape onto said raceboard at an angle.

6. A loom as set forth in claim 5 wherein said tape guide is disposed on a gradient of from 0.2 to 0.8%.

7. A loom as set forth in claim 5 wherein said tape guide has an exit aperture at one end for said tape and said raceboard is disposed at a height of said aperture.

8. A rapier loom comprising a raceboard for supporting a picking tape in a shed of warp yarns;

a picking tape for movement into the shed;

a rapier head secured to said tape and having a center of gravity disposed above a top of said tape; and means for guiding said tape at an inclination towards the shed, said means including a tape guide having an exit aperture at one end for said tape and wherein said raceboard is disposed at a height at least 1 millimeter lower than said aperture.

9. A rapier loom comprising a raceboard for supporting a picking tape in a shed of warp yarns; and a tape guide disposed at an angle to said raceboard for directing a picking tape onto said raceboard at an angle, wherein said tape guide has an exit aperture at one end for said tape and said raceboard is disposed at a height at least 1 millimeter lower than said aperture.

* * * * *

UNITED STATES PATENT AND TRADEMARK OFFICE

CERTIFICATE OF CORRECTION

PATENT NO. : 5,179,979

DATED : January 19, 1993

INVENTOR(S) : Zollinger

It is certified that error appears in the above-indentified patent and that said Letters Patent is hereby corrected as shown below:

Column 1, line 9, change "rapier a a" to --rapier at a--;
line 39, change "know" to --known--.

Column 3, line 11, delete "also" second occurrence;
line 21, after "6" insert --to--;
line 26, after "adjustable" insert --by means of member 6A and screws 9 and 10--.

Signed and Sealed this

Twentieth Day of September, 1994

Bruce Lehman

*Attest:*

BRUCE LEHMAN

*Attesting Officer*

*Commissioner of Patents and Trademarks*